US007008510B2

(12) United States Patent
Kallio et al.

(10) Patent No.: US 7,008,510 B2
(45) Date of Patent: Mar. 7, 2006

(54) ARRANGEMENT IN TAIL THREADING IN A MULTINIP CALENDER OF A PAPER MACHINE

(75) Inventors: Ismo Kallio, Espoo (FI); Juha Laitio, Espoo (FI); Pekka Linnonmaa, Järvenpää (FI)

(73) Assignee: Metso Paper, Inc., Helsinki (FI)

( * ) Notice: Subject to any disclaimer, the term of this patent is extended or adjusted under 35 U.S.C. 154(b) by 118 days.

(21) Appl. No.: 10/687,147

(22) Filed: Oct. 16, 2003

(65) Prior Publication Data

US 2004/0250974 A1 Dec. 16, 2004

(30) Foreign Application Priority Data

Oct. 16, 2002 (FI) ..... 20021844

(51) Int. Cl.
*D21G 1/00* (2006.01)

(52) U.S. Cl. ..... 162/286; 162/193; 162/194; 162/205; 100/167

(58) Field of Classification Search ..... 162/205–207, 162/358.1, 358.5, 359.1, 360.2, 360.3, 361, 162/362, 193, 194, 286; 100/39–42, 331, 100/162 R, 167, 173; 226/91, 92, 95; 242/615
See application file for complete search history.

(56) References Cited

U.S. PATENT DOCUMENTS

| | | | | |
|---|---|---|---|---|
| 3,139,815 | A * | 7/1964 | Du Bois | 100/39 |
| 5,784,955 | A * | 7/1998 | Conrad | 100/329 |
| 6,022,452 | A * | 2/2000 | Caspar | 162/286 |
| 6,325,265 | B1 * | 12/2001 | Munch et al. | 226/91 |

FOREIGN PATENT DOCUMENTS

| | | |
|---|---|---|
| DE | 10115618 | 10/2002 |
| FI | 69145 | 8/1985 |
| FI | 83402 | 3/1991 |
| FI | 84508 | 8/1991 |
| FI | 4362 | 2/2000 |
| FI | 108738 | 3/2002 |
| WO | 00/19013 | 4/2000 |

* cited by examiner

*Primary Examiner*—Eric Hug
(74) *Attorney, Agent, or Firm*—Fildes & Outland, P.C.

(57) ABSTRACT

An arrangement in tail threading in a multinip calender of a paper machine comprises rolls that form nips, extraction rolls as well as tail threading apparatus for guiding the tail to be transferred during tail threading through the multinip calender. The arrangement includes a holding point adapted prior to the last nip and a cutting device. The arrangement further includes a support device adapted at the holding point for supporting the tail during cutting.

5 Claims, 4 Drawing Sheets

ARRANGEMENT IN TAIL THREADING IN A MULTINIP CALENDER OF A PAPER MACHINE

FIELD OF THE INVENTION

This invention relates to an arrangement in tail threading in a multinip calender of a paper machine, the multinip calender comprising rolls that form nips, and extraction rolls arranged on the outlet side of the nips, as well as tail threading means for guiding the tail to be transferred through the multinip calender during tail threading, and the arrangement comprising a holding point adapted prior to the first nip for the tail, as well as a cutting device arranged at the holding point for cutting the tail.

BACKGROUND OF THE INVENTION

The Finnish utility patent registration No. 4362 makes known a tail threading arrangement for a multinip calender. This arrangement includes a draw nip arranged prior to the last nip, up to where the tail is carried with the carrier rope system. At the end of the carrier rope system the tail moves to the draw nip in the cross direction of the multinip calender tightening up at the same time. After this tail threading continues without ropes.

In the arrangement set forth the treatment of the tail is unreliable in spite of several auxiliary devices, such as various doctors and air blows. The auxiliary roll included in the arrangement also requires a doctor of its own as well as positioning means. In addition, the draw nip must be opened during the cutting operation, whereby the tail will have time to slacken again. This often leads to uncontrollable breaking of the tail.

SUMMARY OF THE INVENTION

The present invention provides a new arrangement for tail threading in a multinip calender of a paper machine, which arrangement is more reliable, and simpler than heretofore arrangements.

More specifically, an arrangement in tail threading in a multinip calender of a paper machine, the multinip calender comprising rolls that form nips as well as extraction rolls arranged on the outlet side of the nips, and tail threading means for guiding the tail to be transferred during tail threading through the multinip calender, and the arrangement comprising a holding point arranged prior to the last nip for the tail and a cutting device arranged at the holding point for cutting the tail, is characterized in that the arrangement further comprises a support device adapted at the holding point for supporting the tail during the cutting operation.

The holding point may be arranged between the nip of one roll or an extraction roll and the auxiliary roll included in the arrangement, the auxiliary roll being formed of several rotating discs arranged in the same line, at a distance of each other.

The support device may be a vacuum belt conveyor, which is arranged after the auxiliary roll in the travel direction of the tail, and in connection with which the cutting device is adapted. Also the support device may be a vacuum belt conveyor, which is arranged with one roll or the extraction roll, the holding point thus being formed at the support device.

The cutting device may be arranged with the latter end, in the travel direction of the tail, of the vacuum belt conveyor, after which the following tail threading means is arranged.

In the arrangement according to the invention the tail is supported with a specific supporting device during cutting. This makes tail threading more reliable. The holding point can also be arranged in different ways. The devices used are simple and they can be used for example without doctors. However, the effect of the devices on the other tail threading means is slight.

These and other features and advantages of the invention will be more fully understood from the following detailed description of the invention taken together with the accompanying drawings.

DETAILED DESCRIPTION OF THE INVENTION

Figure 1:
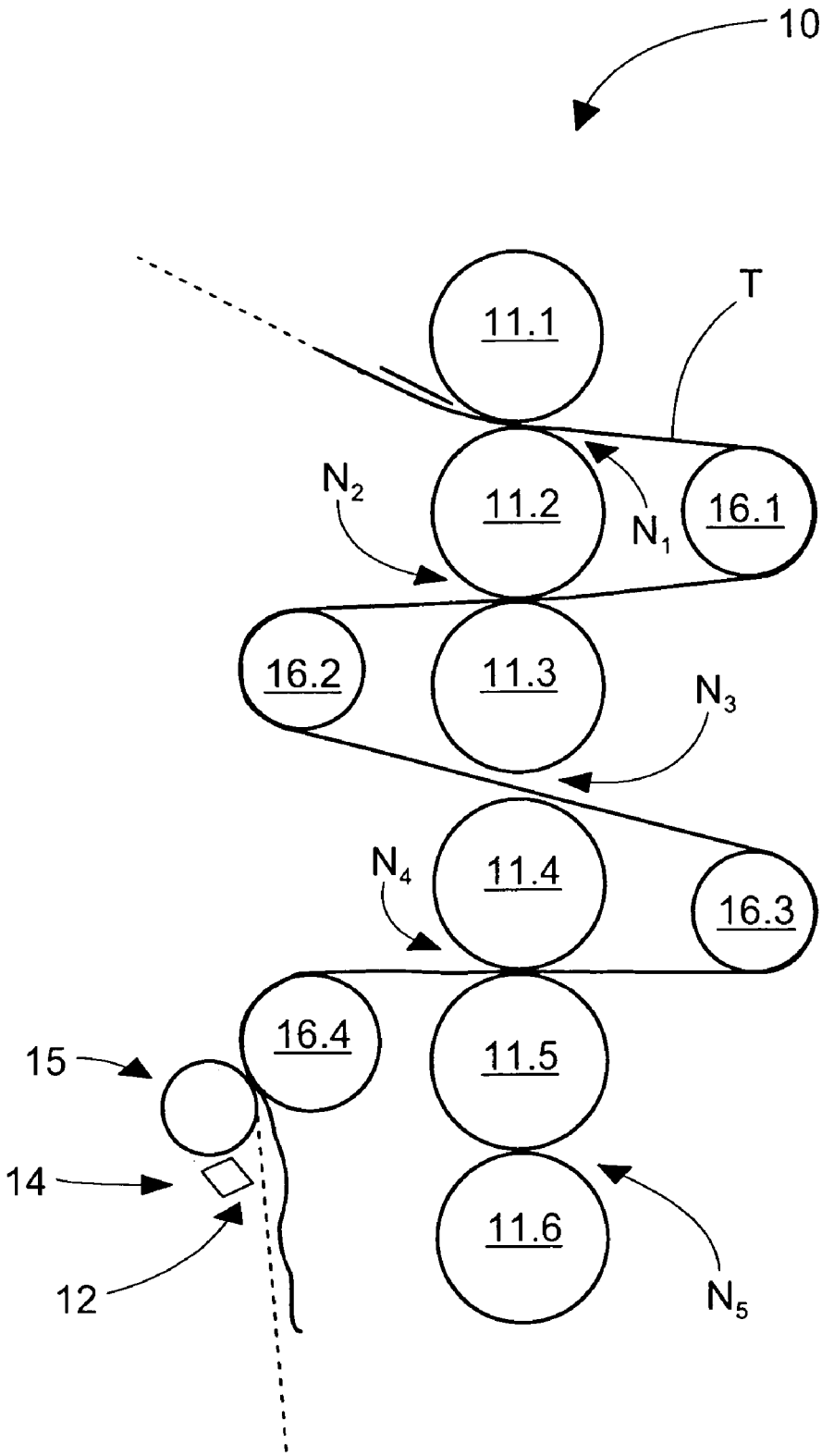
FIG. 1 shows a principal drawing representing the side view of the arrangement according to the invention.

Referring now to the drawings in detail, FIG. 1 shows a principal drawing of a multinip calender 10 known as such and an arrangement according to the invention adapted thereto. The use of the arrangement is particularly useful for a so-called on-line calender, in which the tail is transferred through the multinip calender at the production speed. Successful tail threading is thus of primary importance in order to keep production breaks as short as possible. The multinip calender, later referred to as calender 10 for simplification, comprises rolls 11.1–11.6 that form nips $N_1$–$N_5$, as well as extraction rolls 16.1–16.4 arranged on the outlet side of the nips $N_1$–$N_5$. In addition, the calender includes various tail threading means for guiding the tail to be transferred through the calender during tail threading (not shown). In the embodiments set forth the tail is taken almost entirely through the calender with a rope carrier system until to the holding point 12. In FIG. 1 the rope of the carrier rope system is partly shown while it is arriving in the calender 10 and leaving the calender 10. The holding point 12 is adapted prior to the last nip $N_5$ with a cutting device 14 arranged in connection with it for cutting the tail T. In practice, it is at the holding point that the tail moves from the rope to the holding point in the cross direction of the multinip calender and further down to the broke treatment (FIG. 1). At the holding point the tail tightens up and its travel becomes stabilized.

Next the calmed down tail is cut and guided towards the last nip $N_5$ using a suitable tail threading means. According to the invention, the arrangement further includes a support device 15 adapted at the holding point 12 for supporting the tail T during cutting. Thus both the tail cutting and the successive tail threading operation are more controllable than heretofore and thereby more reliable.

Figure 2:
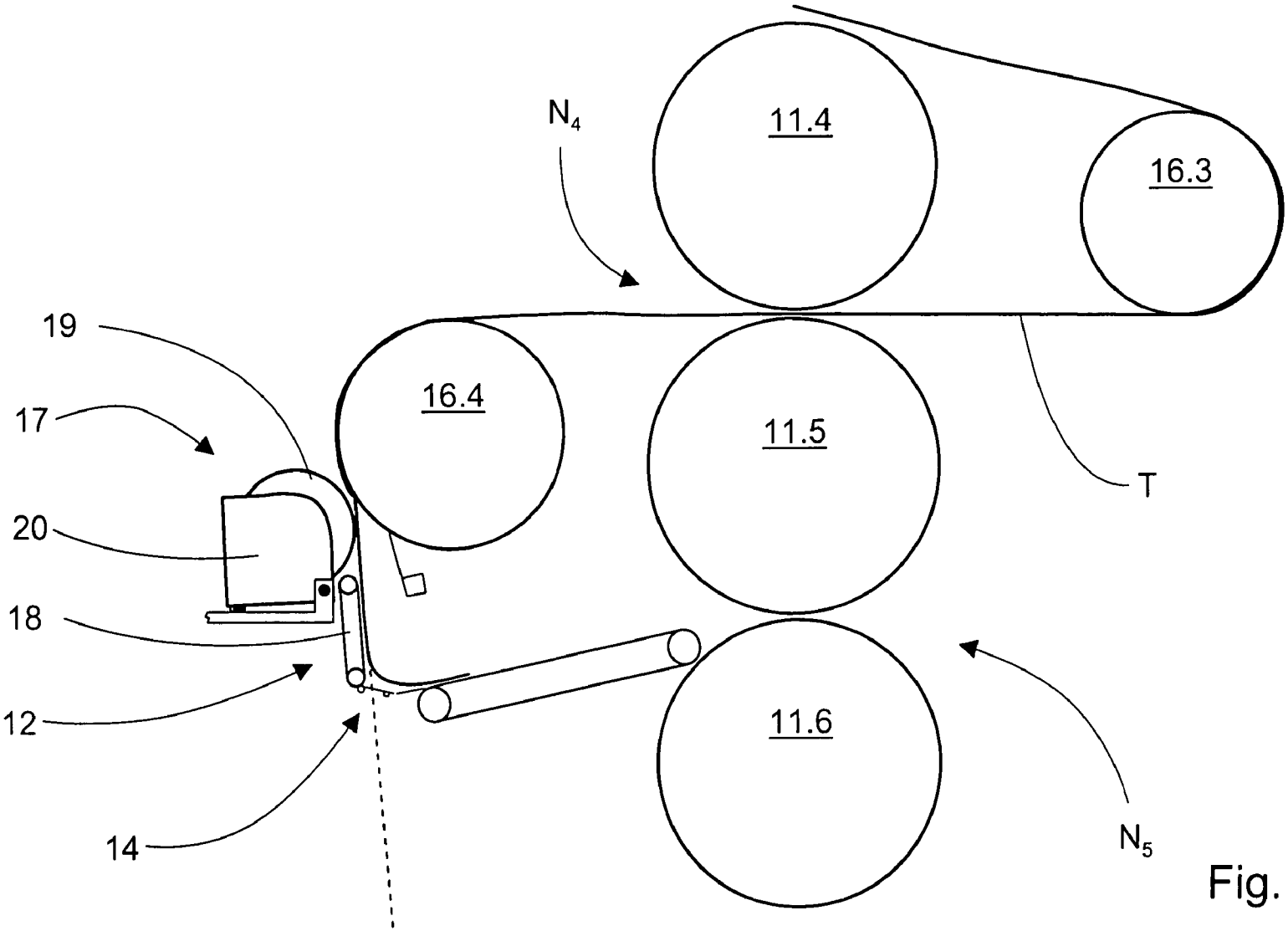
FIG. 2 shows an enlarged view of the first embodiment of the arrangement according to the invention.

FIG. 2 shows the first embodiment of the arrangement according to the invention. Here the holding point 12 is arranged in the nip between one roll 11.1–11.6 or an extraction roll 16.1–16.4 and the auxiliary roll 17 included in the arrangement. The auxiliary roll 17 is most advantageously adapted in connection with the last extraction roll 16.4, whereby for example the broke treatment is easy to arrange.

In addition, the support device 15 is a vacuum belt conveyor 18, which is arranged in the travel direction of the tail T after the auxiliary roll 17. Furthermore, the cutting device 14 is adapted in connection with the auxiliary roll 17. Thus the tail remains supported and tense for the entire duration of the cutting operation. FIG. 2 shows a situation during tail threading wherein the tail has been cut a moment ago and has already reached the following tail threading means. In this situation the auxiliary roll 17 is turned off the extraction roll 16.4 surface with the holding point moving to the vacuum belt 18. Thus the tail is all the time supported and tense during the cutting operation. Vacuum belt conveyors are advantageously used in tail threading also after the cutting operation. The vacuum belt conveyor used is preferably the equipment proposed in the WO publication No. 0019013, but other vacuum belt conveyors are also possible. The same reference numbers are used for functionally similar parts.

Figure 3:
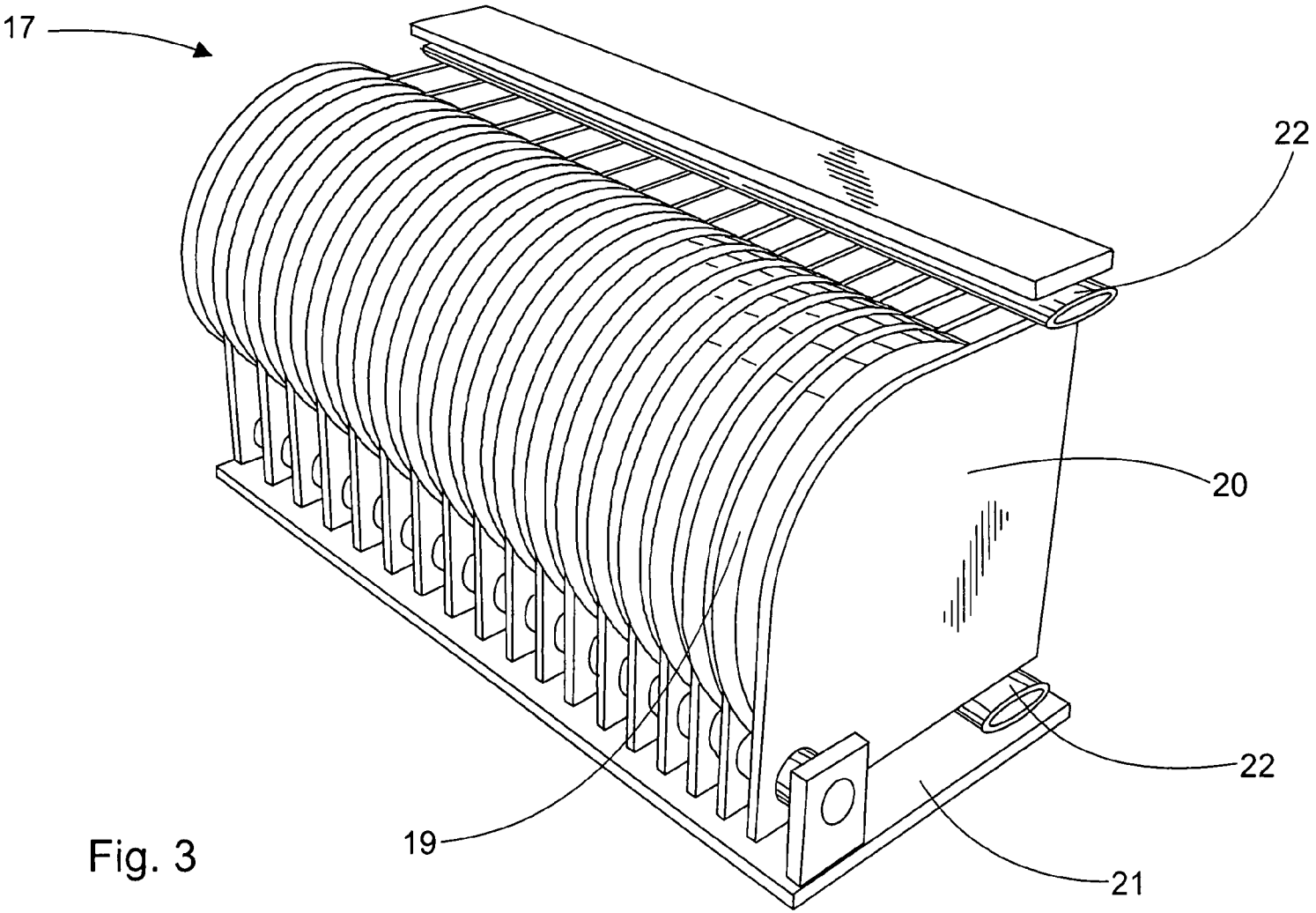
FIG. 3 shows a perspective view of the auxiliary roll of the embodiment illustrated in FIG. 2.

FIG. 3 shows in greater detail the auxiliary roll 17 according to the invention. The auxiliary roll 17 is formed of several rotating discs 19 arranged in the same line and placed at a distance from each other. In addition, each disc 19 is fitted with a bearing on a disc-like bracket 20, the bracket being correspondingly pivoted to the auxiliary roll frame 21. Thus the discs rotate and move independently of each other allowing the auxiliary roll adapt exactly to the counter roll surface. The auxiliary roll also comprises loading hoses 22, which can be used to open and close the nip. The loading hoses can be loading hoses known for doctors. Due to the disc-like brackets, a separate doctor is not required with the auxiliary roll, because the brackets force the tail to detach from the surfaces of the disc. In one embodiment the disc diameter is 150 mm and the disc thickness is 25 mm. By arranging approximately 20 discs in one auxiliary roll at a distance of 20 mm, it is provided an auxiliary roll with a length of approximately 900 mm. The length of the auxiliary roll is selected case-specifically; however, the use of one type of discs simplifies the manufacture. Thus the suitable length of the auxiliary roll is determined based on the number of discs and brackets. In addition, for the disc material, a material softer than the respective roll is selected thus avoiding roll wear. On the other hand, wear is a slight problem because the nip is closed only during tail threading.

Figure 4:
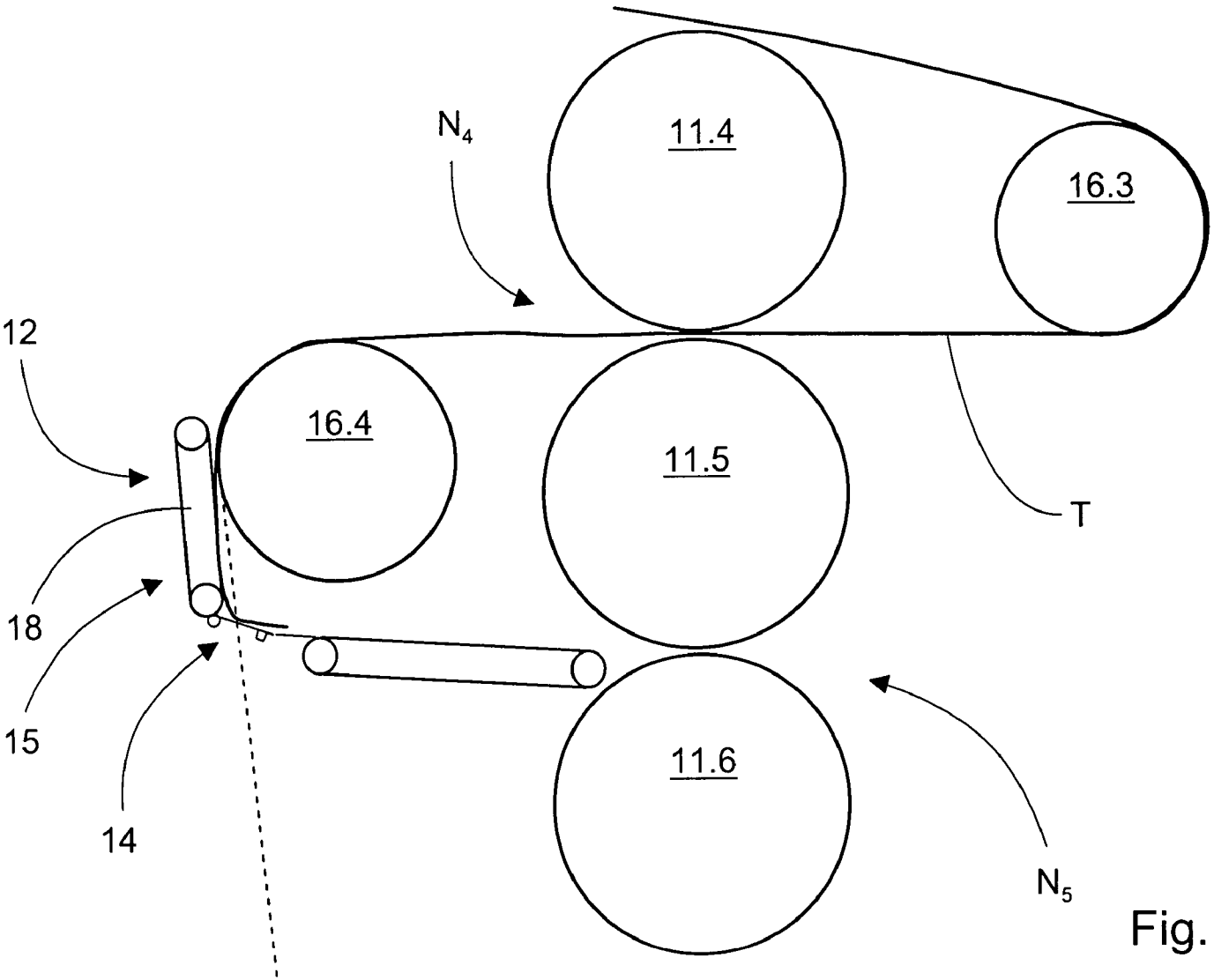
FIG. 4 shows an enlarged view of the second embodiment of the arrangement according to the invention.

FIG. 4 shows the second embodiment of the arrangement according to the invention. Here, too, the support device 15 is a vacuum belt conveyor 18, but it is unexpectedly arranged directly in connection with one roll 11.1–11.6 or an extraction roll 16.1-16.4. Thus the holding point 12 is immediately formed at the support device 15 unlike in the embodiment described above. In the embodiment set forth, as the tail T arrives at the extraction roll 16.4 with the rope, it is immediately transferred to under the influence of the vacuum belt conveyor 18 as shown in FIG. 4 without contacting the extraction roll 16.4. In addition, the cutting device 14 is arranged with the latter end, in the travel direction of the tail T, of the vacuum belt conveyor 18, after which there is adapted the following tail threading means. In FIG. 4 the tail has just been cut while the holding point is still at the vacuum belt conveyor. In the second embodiment set forth the vacuum belt conveyor remains detached from the calender roll or the extraction roll at all times. Due to the effect of the vacuum the tail moves reliably from the rope to the vacuum belt, in which case doctoring of the roll or the extraction roll is unnecessary. In this embodiment a relatively wide vacuum belt is used to allow the tail move controllably from the rope to the following tail threading device in the cross direction of the calender. Practically, the movement of the loose tail in the cross direction of the calender is less than 500 mm.

The cutting device described in the embodiments is a flap cutter, but other types of cutting devices are also possible. In the embodiment shown in FIG. 4 the cutting device is placed immediately after the vacuum belt conveyor prior to the following tail threading means, in which case for example the air blows used heretofore are not needed. In that way the tail travels undisturbed and reliably in spite of the cutting operation.

The arrangement of the invention is simple and reliable. The change of the threading method from the carrier rope system to the ropeless system can be carried out quickly and automatically in the practical use. In addition, a cutting device incorporated in the support device provides a quick and undisturbed tail threading operation. Supporting the tail during the cutting operation is particularly important. Due to the simple design, the arrangement according to the invention can be easily adapted in connection with various calender rolls.

Although the invention has been described by reference to a specific embodiment, it should be understood that numerous changes may be made within the spirit and scope of the inventive concepts described. Accordingly, it is intended that the invention not be limited to the described embodiment, but that it have the full scope defined by the language of the following claims.

What is claimed is:

1. An arrangement in tail threading in a multinip calender of a paper machine, the multinip calender comprising rolls that form hips as well as extraction rolls arranged on the outlet side of the nips, and tail threading means for guiding the fail to be transferred during tail threading through the multinip calender, the arrangement comprising a holding point for the tail arranged prior to the last nip, after the nip prior to the last nip the tail threading means comprises a rope carrier system continuing to the holding point, and a cutting device arranged at the holding point for cutting the tail running down to a broke treatment, characterized in that the arrangement further comprises a support device adapted at the holding point for supporting the tail during the cutting operation.

2. An arrangement according to claim 1, characterized in that the holding point is arranged between the nip of one roll or an extraction roll and an auxiliary roll included in the arrangement, the auxiliary roll being formed of several rotating discs arranged in the same line, at a distance of each other.

3. An arrangement according to claim 2, characterized in that the support device is a vacuum belt conveyor, which is arranged after the auxiliary roll in the travel direction of the tail, and in connection with which the cutting device is adapted.

4. An arrangement according to claim 1, characterized in that the support device is a vacuum belt conveyor, which is arranged with one roll or the extraction roll, the holding point thus being formed at the support device.

5. An arrangement according to claim 4, characterized in that the cutting device is arranged with the latter end, in the travel direction of the tail, of the vacuum belt conveyor, after which the following tail threading means is arranged.

* * * * *